United States Patent [19]

Nakajima

[11] 4,448,013

[45] May 15, 1984

[54] AUTOMATIC CARTON PACKING MACHINE

[75] Inventor: Mutsuhiko Nakajima, Soka, Japan

[73] Assignee: Ace Pak Company Incorporated, Japan

[21] Appl. No.: 250,282

[22] Filed: Apr. 2, 1981

[51] Int. Cl.[3] ..... B65B 43/26

[52] U.S. Cl. ..... 53/565

[58] Field of Search ..... 53/565, 564, 467, 468, 53/491, 272, 276, 282, 299, 378, 379, 481, 374

[56] References Cited

U.S. PATENT DOCUMENTS

| | | | |
|---|---|---|---|
| 3,120,089 | 4/1964 | Monroe | 53/565 |
| 3,456,419 | 7/1969 | Vadas | 53/565 X |
| 4,063,403 | 12/1977 | Bergstein | 53/379 |

*Primary Examiner*—A. J. Heinz

*Attorney, Agent, or Firm*—McGlew and Tuttle

[57] ABSTRACT

An automatic carton packing machine comprising: a withdrawing device adapted to withdraw carton blanks having sealed bottoms and fitting mandrels vertically downwardly from said mandrels; a push-out device adapted for successively pushing out the carton blanks in the horizontal direction on a table; a conveyor device including bucket portions and arranged at a right angle to the direction of the pushing out and for accomodating the carton blanks in a row and plat portions formed at both sides of the bucket portions; a folding device adapted to fold the upper edges of the carton top along the folding line to impart a folding habit to the carton top; and a device for triangular lugs adapted for bending, after completion of the sealing of the carton top having the folding habit and withdrawal of the carton blanks from the bucket portions of the conveyor device; the triangular lugs of the carton top downwardly and bonding the same to the side surfaces of the carton.

6 Claims, 43 Drawing Figures

AUTOMATIC CARTON PACKING MACHINE

BACKGROUND OF THE INVENTION

The present invention relates to an apparatus for forming a carton for use as a container for liquids such as cow's milk, fruit juice or the like, filling the carton with the liquid, forming of the carton top and sealing of the same. More particularly, the present invention makes proposals concerning the device for shifting carton blanks with bottoms sealed in the above-mentioned apparatus to a bucket conveyor, construction of the bucket conveyor, construction of a folding device for shaping the top of the carton filled with the liquid and the construction of a device for treating the triangular projection (lug) formed when the carton top is formed into flat shape.

The apparatus for forming the carton, filling the carton, forming the carton top and sealing the same will be generally referred to as "automatic carton packing machine", hereinafter. The automatic carton packing machine is required to fulfill various requirements such as high treating capacity (yield), compactness, and so forth. In addition, the automatic packing machine is required to treat cartons irrespective of the shape of the latter.

In the conventional automatic carton packing machine, carton blanks with sealed bottom are placed in the frame of a chain conveyor one by one, and a series of operation such as filling of cartons with the liquid, formation of the carton top and sealing of the same is performed while the carton blanks are conveyed by the chain conveyor. Therefore, there is a practical limit in the speed of operation. Particularly, the step of shifting of the carton blanks with sealed bottom to the frame of the chain conveyor, after withdrawal of the same from the mandrel, is made at an extremely low efficiency to inconveniently limit the efficiency of the work.

There are two types of folding of the carton top after filling with the liquid: namely a flat top as shown in FIG. 1 and gable top as shown in FIG. 2. Hitherto, these shapes of the carton top are formed by different folding devices. In other words, for obtaining both of these two types of the carton top, it has been necessary to employ two different devices. In the case of the flat carton top as shown in FIG. 1, triangular projections or lugs are formed at each side of the carton top. It is necessary to fold these lugs down onto both side surfaces of the carton, because such lugs will hinder the transportation, storage and display of the cartons. To this end, it has been necessary to employ a suitable measure or arrangement such as provision of an elongated guide in the direction of running of the chain conveyor, to fold down the lugs toward the side surfaces of the carton. This requires, however, an impractically large length of the machine as a whole.

SUMMARY OF THE INVENTION

It is, therefore, a first object of the invention to make it possible to array the carton blanks withdrawn from the mandrels on a table and to shift these cartons at a high efficiency to the bucket conveyor.

It is a second object of the invention to provide a form of the bucket conveyor which facilitates the treatment of the triangular projection or lug of the flat top type carton.

It is a third object of the invention to provide a machine capable of producing both of the flat top type carton and gable top type carton.

It is a fourth object of the invention to make it possible to treat the rectangular portion of the flat top type carton at a high efficiency.

It is a fifth object of the invention to reduce the size of the machine as a whole.

To this end, according to the invention, there is provided an automatic carton packing machine comprising: a withdrawing device adapted to withdraw carton blanks having sealed bottoms and fitting mandrels vertically downwardly from the latter; a push-out device adapted for successively pushing out the carton blanks in the horizontal direction on a table; a conveyor device including bucket portions arranged at a right angle to the direction of pushing out and for accomodating the carton blanks in a row and flat portions formed at both sides of the bucket portion; a folding device adapted to fold the upper edge of the carton top along the line to impart a folding habit to the carton top; and a device for treating the triangular lugs adapted for bending, after completion of the sealing of the carton top having folding habit and withdrawal of the carton blanks from the buckets of the conveyor device, the triangular lugs of the carton downwardly and bonding the same to the side surfaces of the carton.

Other objects and advantageous features of the invention will become clear from the following description of the preferred embodiments taken in conjunction with the accompanying drawings.

DETAILED DESCRIPTION OF THE PREFERRED EMBODIMENTS

Figure 3:
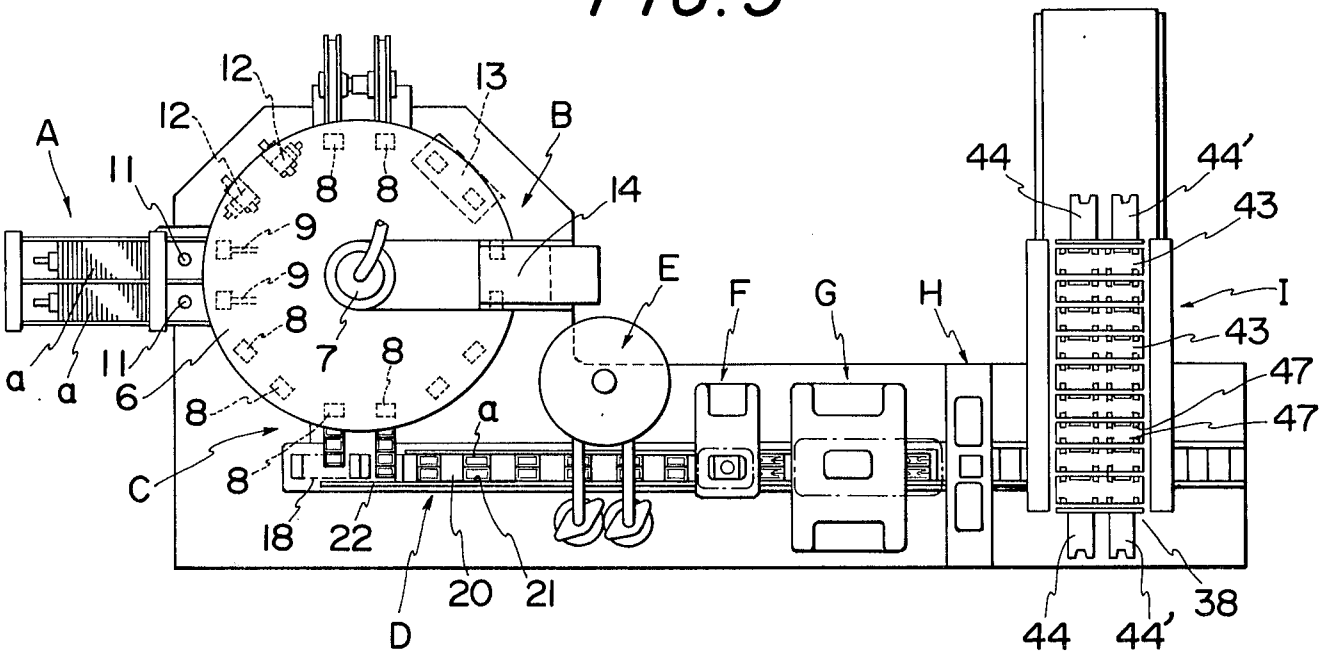
FIG. 3 is a plan view of the whole part of an automatic carton packing machine.
Figure 4:
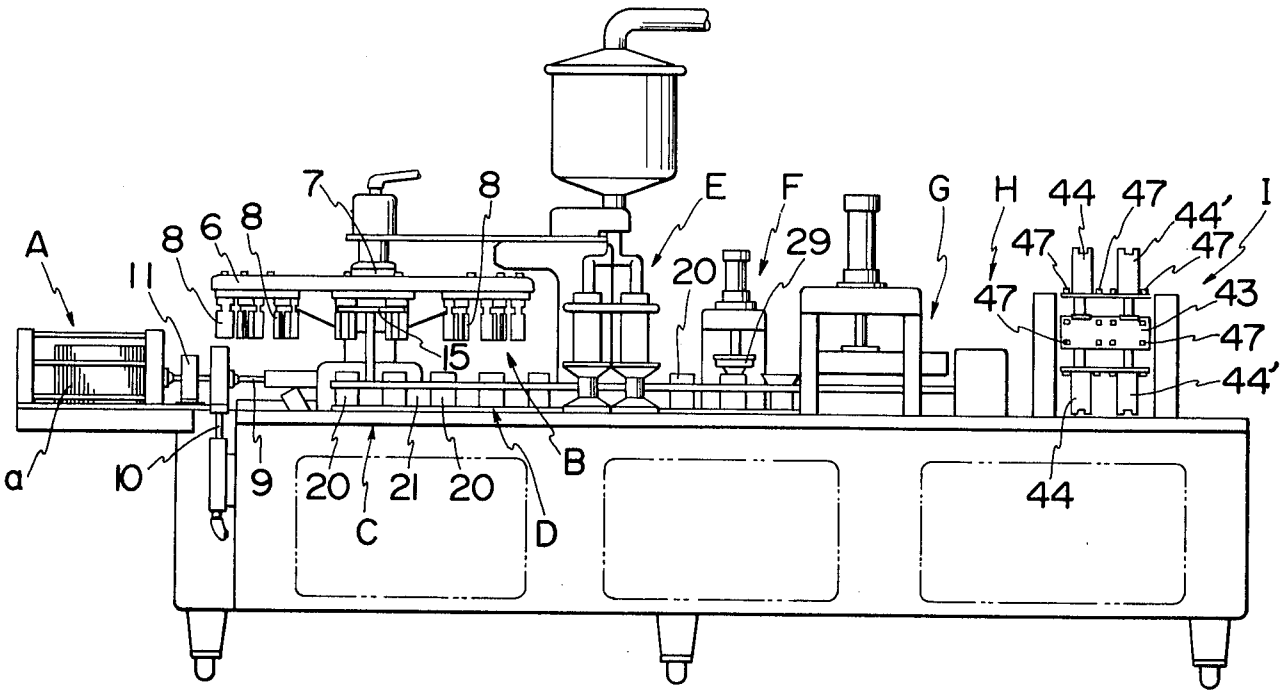
FIG. 4 is a front elevational view of the machine shown in FIG. 3.

FIGS. 3 and 4 show the whole part of an automatic carton packing machine in accordance with the present invention.

Figure 1A:
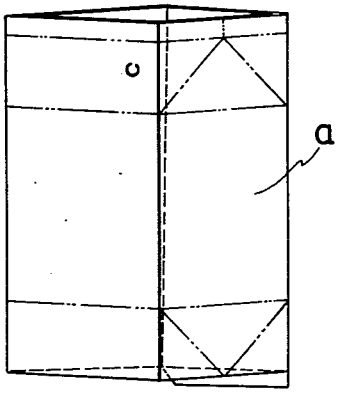
FIGS. 1A' to 1F' are perspective views showing a process for forming a flat top type carton and sealing the top of the carton.
Figure 1B:
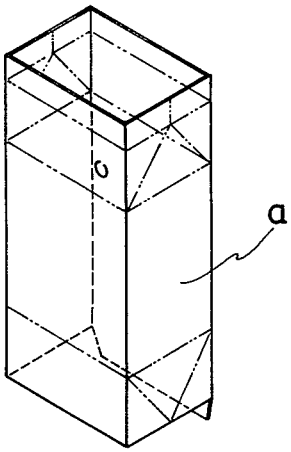
Figure 1D:
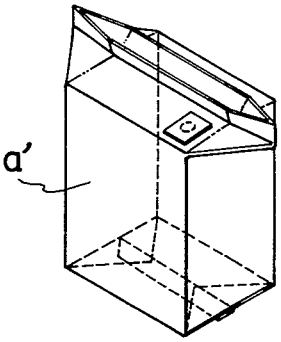
Figure 1C:
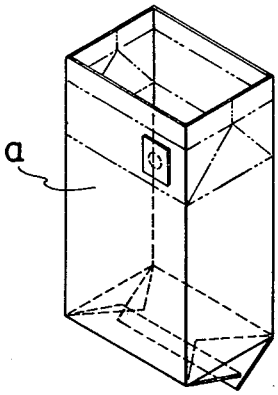

Referring to these Figures, a symbol A designates a magazine which accomodates carton blanks folded in a flat form. The state of flattened carton blank a corresponds to FIGS. 1A' and 2A'. A symbol B denotes a bottom sealing device adapted for sealing the bottom of the carton blanks extracted from the magazine. A shifting device for shifting the cartons with sealed bottoms to a conveyor device D is designated at a symbol C. A symbol E designates a filling device for filling the carton blanks held in the buckets of the conveyor device D with a liquid to a predetermined level.

A reference symbol F denotes a folding device for imparting a folding habit to the opening of the carton a' filled with the liquid, by folding the same along the folding line.

For a clarification of the explanation, the carton before filling with the liquid will be referred to as "carton blanks", while the carton filled with the liquid will be referred to as "carton" a'.

A reference symbol G designates a heating device for heating the opening of the carton a' having the folding habit, while H denotes a sealing device for sealing the top of the carton a' after the heating.

Finally, a symbol I designates a treating device for treating the triangular lugs formed on the flat top of the carton a' during the folding and sealing.

The automatic carton packing machine of the invention is constituted by the devices mentioned above, the operation of each of these devices will be explained hereinafter.

The magazine A of a known type accomodates a plurality of carton blanks a as illustrated. A pressure is applied to the rear side of these blanks to push them forwardly. Means are provided for making additional supply of the carton blanks as the number of carton blanks in the magazine A becomes small.

The bottom sealing device 7 has a horizontal disc 6 attached to a central shaft 7, two rectangular mandrels 8 projecting downwardly from the disc 6 and provided with relief grooves 8' and withdrawal grooves 8'', a vacuum bar 9 for withdrawing the carton blanks a horizontally from the magazine A, guide rollers 11 adapted to open the carton blanks a into rectangular form upon abuting a portion of the carton blank a after withdrawal of the latter from the magazine A by the vacuum bar 9, a push-up bar for pushing up the carton blank a opened in the rectangular form to fit the same to the mandrels 8, a folding device 12 for imparting a folding habit to the carton blanks a fitting to the mandrels, a bottom heating device 13 for heating the bottom of the carton blanks a having the folding habit and a bottom sealing device 14 for collapsing the heated bottoms of the carton blanks to seal the bottoms.

The above-described construction of the bottom sealing device B is known. The discs 6 are adapted to rotate intermittently, and various works mentioned above are performed during the suspension of rotation of the discs 6.

Figure 5:
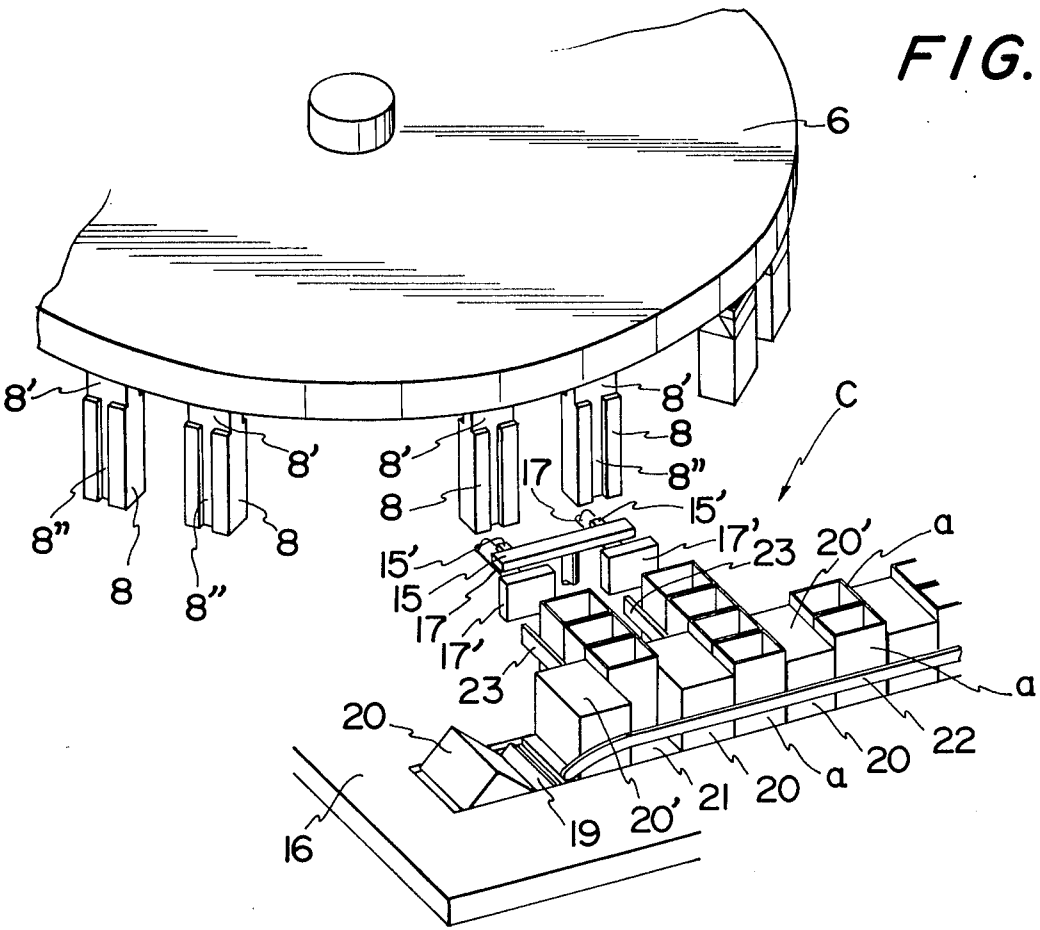
FIG. 5 is a perspective view of a shifting device including discs, mandrels and a conveyor.

The shifting device C, which is shown in detail in FIG. 5, constitutes an essential part of the invention. This shifting device C includes a withdrawing bar 15 having a withdrawing claw 15' adapted to engage the top edge of the carton blanks a having sealed bottoms, a table on which the carton blanks a after the withdrawal are placed, a push-out bar 17 having a push-out plate 17' adapted to push out the carton blanks a on the table 16 in the horizontal direction, and a guiding frame 23 mounted on the table 16 and adapted for guiding the carton blanks a such that the latter move in a row. The withdrawing bar 15 is adapted to be actuated by a pneumatic cylinder. Withdrawing claws 15 of the same construction are provided at front and rear sides of the bar 15 so that the carton blank a is clamped at front and rear sides thereof when it is withdrawn.

The push-out bar 17 is also actuated by a pneumatic cylinder, so as to effect a repititional operation to push-out the carton blanks a, which have been withdrawn by the withdrawing bar 15 and placed on the table 16, one by one. The pushing out of the carton blanks a is made during returning of the withdrawing bar 15 and the push-out bar 17 is reset when the withdrawing bar 17 starts the withdrawing operation. The withdrawing bar 15 and the push-out bar 17 may be actuated by a cam mechanism.

Figure 6:
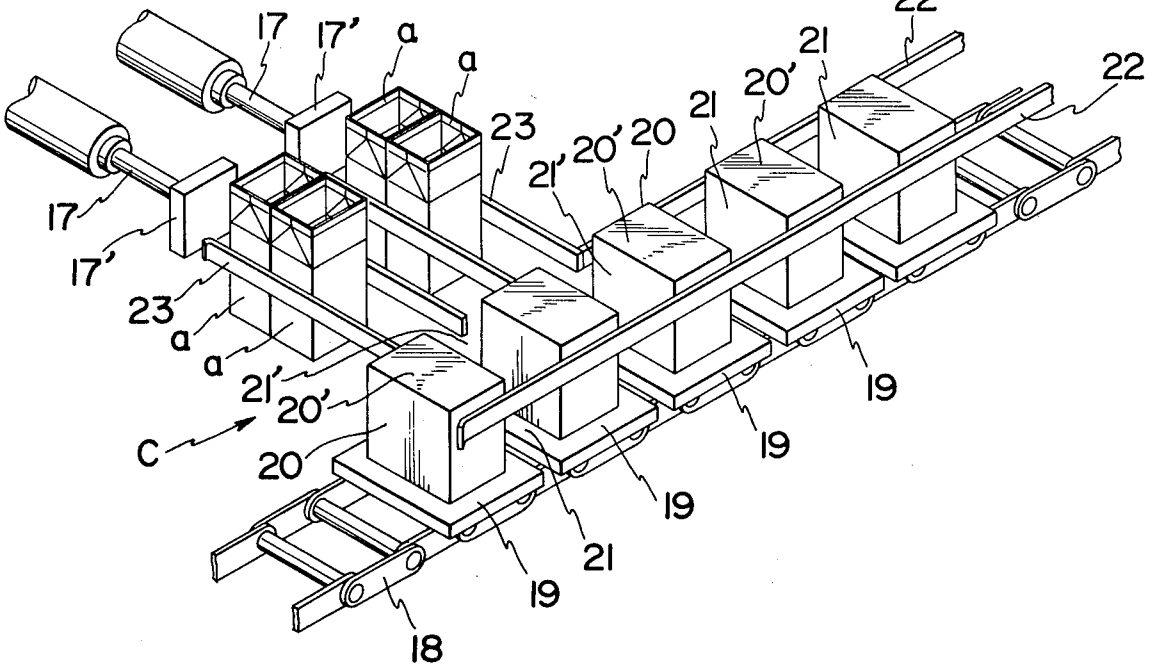
FIG. 6 is a perspective view of the shifting device.
Figure 7:
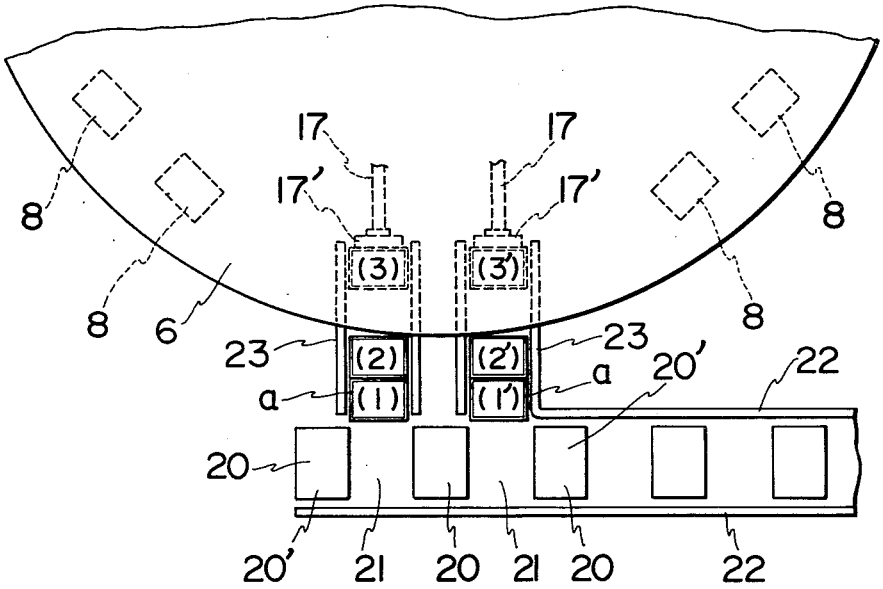
FIGS. 7 to 11 are plan views showing the steps of operation of the shifting device.

As will be seen from FIGS. 4, 5 and 6, the conveyor device D includes a chain 18 disposed at one side of the bottom shifting device C so as to run in the direction perpendicular to the direction of pushing out of the carton blanks a, rectangular blocks 20 mounted on the bottom plate 19 of the chain 18, bucket portions 21 defined between adjacent blocks 20, and a guide rail 22 disposed in the vicinity of the blocks 20 and arranged along the movement path of the blocks 20 (chain 18). The bucket portion 21 is oprned at its upper side and at its sides perpendicular to the direction of running. The height of the flat top surface 20' of the block 20 is equal to the height of the carton blanks a except the height of the top seal of the latter.

The guide frame 23 is so arranged that the ends thereof are positioned at bot sides of the opened sides 21' of the bucket portion 21 when the latter is stopped. In the illustrated embodiment, each bucket portion 21 has a length for just receiving two carton blanks a and a width corresponding to that of one carton blank a.

The shifting device C has a construction as explained above. The chain 18 is adapted to run intermittently in a timed relation to the intermittent running of the conveyor device D, and the shifting operation of the device is made in a sequence shown in FIGS. 7 to 11.

Figure 8:
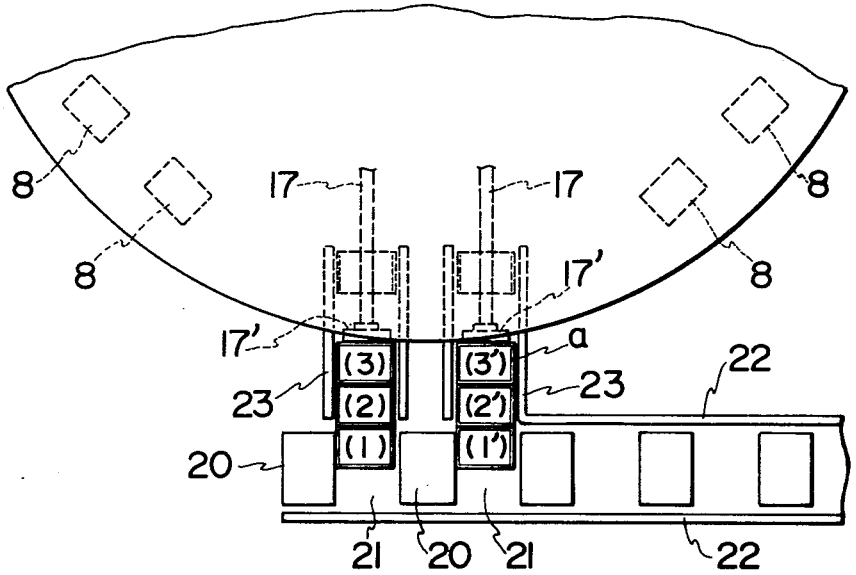
Figure 9:
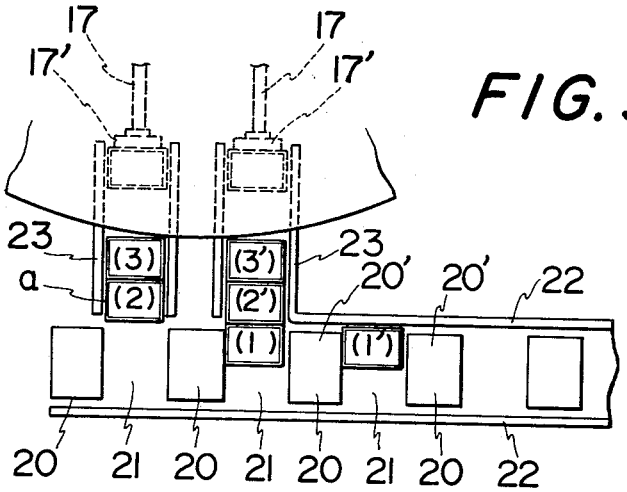
Figure 10:
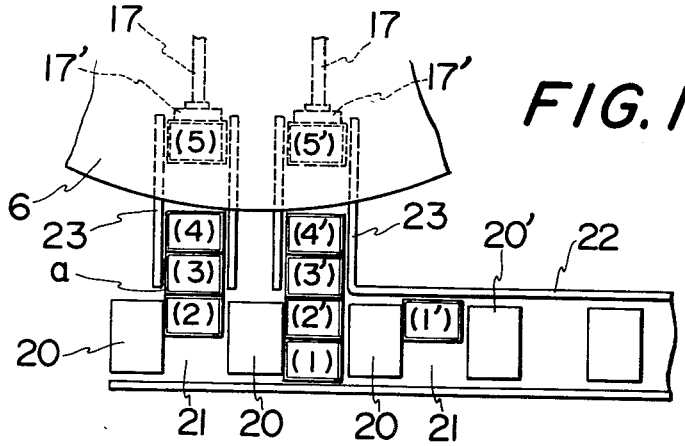
Figure 11:
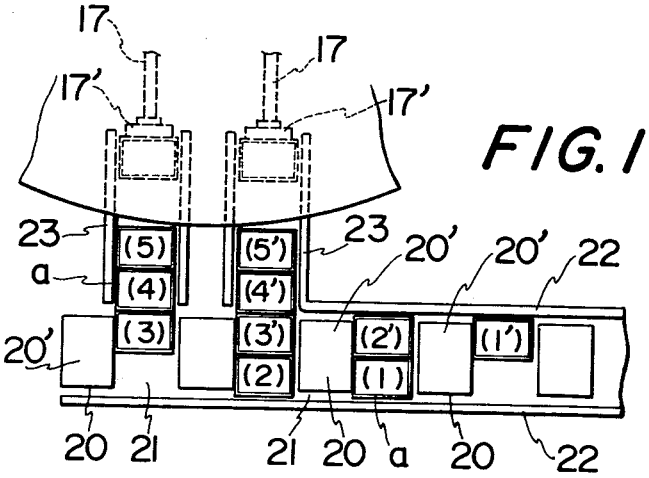
Figure 30:
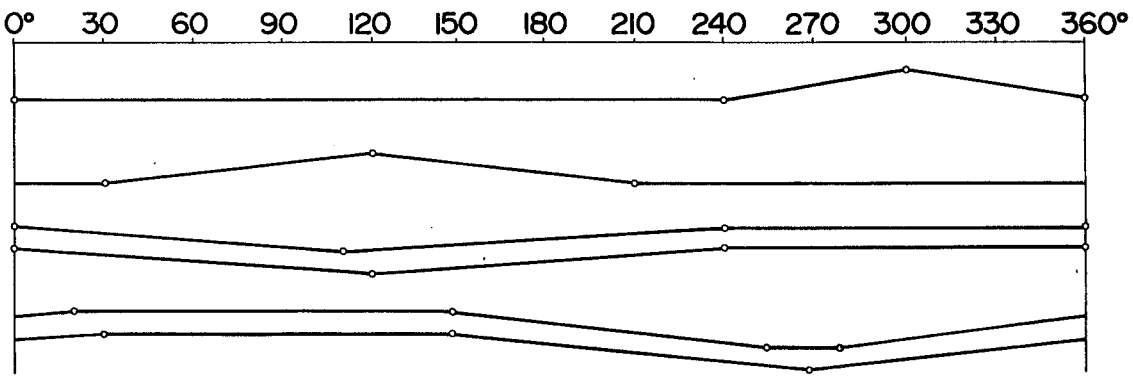
FIG. 30 is a timing chart of operations of the disc, bucket portion, withdrawing bar, and push-out bar.

Namely, two carton blanks a are withdrawn from the mandrel 7 by the withdrawing bar 15 as shown in FIG. 5, and are placed on the table 16 in a side-by-side relation. Then, the push-out bar 17 is actuated to push out one carton blank a. As this operation is repeated, in the state shown in FIG. 7, three carton blanks 1,2,3; 1',2',3' are arrayed in each row, in the guide frame 23. Then, the push-out bar 17 is advanced by a distance corresponding to one carton blank, so that the carton blanks 1,1' at the leading sides of both rows are pushed into the bucket portion 21 of the conveyor 18, as illustrated in FIG. 8. Thereafter, two carton blanks a are withdrawn newly from the mandrels 8 and placed at the trailing ends of both rows in the guide frame 21. Meanwhile, the chain 18 runs a distance corresponding to one pitch of the bucket portion 21 and is then stopped (See FIG. 9). The push-out bar 17 is then actuated again while the bucket 21 is stopped to push one carton 4,4' of each row so that the leading carton blanks 2,2' are pushed into the new bucket portion 21. As a result of this pushing operation, the carton blank 1, which is one of the carton blanks 1,2 pushed into the bucket portion 21 in advance, is pushed by the new carton blank 2' by one pitch of the carton blank deeper into the bucket portion 21, so that this bucket portion now receives two carton blanks 1,2'. Then, new pair of carton blanks 5,5' are withdrawin from the mandrels 8. Meanwhile, the chain 18 runs and stops after moving over a distance corresponding to one pitch of the bucket portion 21. Thereafter, the push-out bar 17 is actuated again to push the new carton blanks 5,5' by one pitch of the carton blank a, so that the third carton blanks 3,3' are forced into the bucket portion 21, in such a manner that the carton blank 3' pushes the carton blank 2 deeper into the bucket portion 21 by one pitch of the carton blank a, so that this bucket portion 21 accomodates two carton blanks 2,3' as will be seen from FIG. 11. This operation is repeated to charge two carton blanks a into each of the successive bucket portions 21. The discs 6, bucket portion 21 (chain conveyor 18), carton withdrawing bar 15 and the carton push-out bar 17 operate in accordance with a timing chart shown in FIG. 30.

As explained above, the shifting device is so constructed as to withdraw the carton blanks from the mandrels vertically downwardly, to push out the withdrawn carton blanks a by one pitch of the carton blank a and to slide the carton blanks laterally into the bucket portion 21. Since the operation of each part is a repetition of a simple linear action, it is comparatively easy to obtain such a setting that the time length in which the operation is stopped is elongated while the time length in which each part moves is shortened.

In the case of the disc 6, it is possible to preserve a considerably long time of stopping or suspension of rotation for various works such as folding of the bottoms of the carton blanks, sealing of the same, and the withdrawal of the carton blanks, while shortening the time for the rotation. Particularly, in the case of the bucket portion, it is quite convenient to preserve a time sufficiently long for various works such as filling of the carton with the content, folding of the carton top and sealing of the same, while shortening the running period. The disc 6 and the bucket portion 21 operate at different conditions of timing. The difference of operation timing, however, can be adjustable and absorbable by the timing of the withdrawal of the carton blanks and the timing of pushing out of the same. It is, therefore, possible to obtain in the shifting device in accordance with the invention to obtain an optimum relation of operation timing between the disc 6 and the bucket portion 21.

The carton blanks a are kept in vertical posture during the shifting and are never turned over nor rotated, so that the shifting of the carton blanks is made in quite a smooth way. In addition, since the bucket portion 21 is so sized as to accomodate two carton blanks, the efficiency is doubled as compared with that of the conventional chain conveyor in which each bucket portion can accomodate only one carton blank. In addition, the invention can be modified without substantial difficulty to meet such a requirement as to increase the capacity of each bucket portion to accomodate three carton blanks. In such a case, it is possible to obtain an efficiency which is three times as high as that of the conventional shifting device. It is also to be noted that the shifting device in accordance with the invention occupies only a small area so that the size of the machine as a whole can be reduced considerably.

The automatic filling device E is a known one adapted to fill the container up to a predetermined level. The folding device F is positioned at the downstream side of the automatic filling device E as viewed in the direction of flow of the carton blanks. There are two types of folding device: namely a folding device for flat top type carton and a folding device for gable top type carton blank. The folding device can be replaced with another type of the folding device depending on the type of the carton, i.e. in accordance with the shape of the carton top to be treated.

Figure 12:
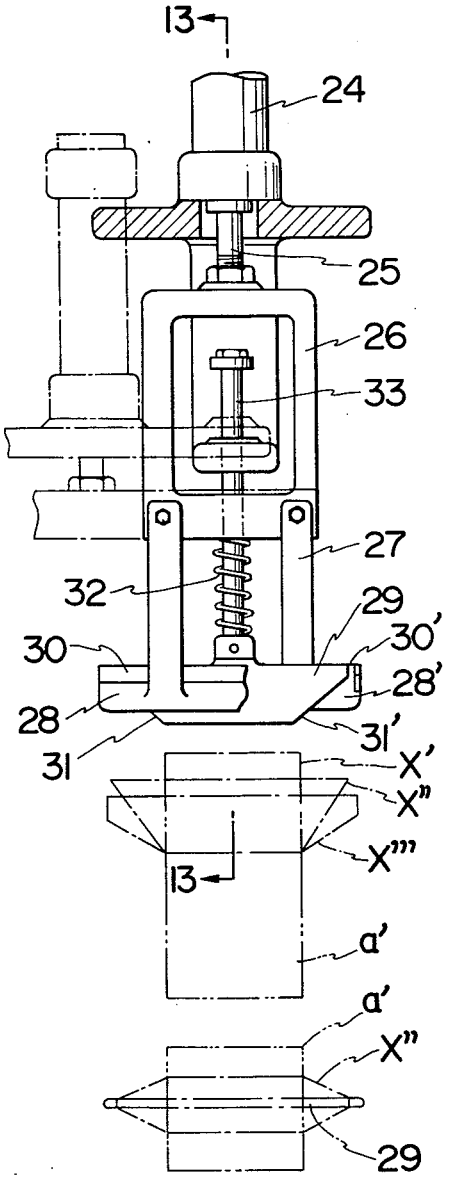
FIG. 12 is a front elevational view of a folding device for imparting a folding habit to the top of a flat top type carton.
Figure 13:
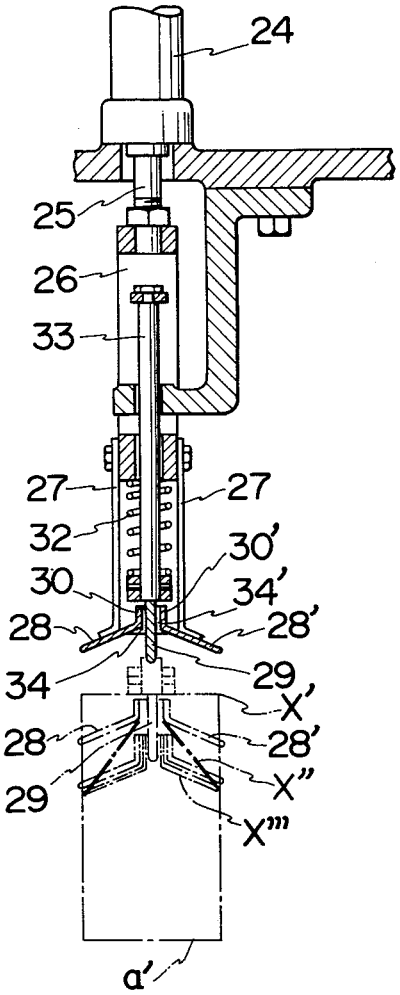
FIG. 13 is a sectional view taken along the line A—A of FIG. 12.

FIGS. 12 and 13 shows the folding device adapted for making a folding habit of flat top type. This device includes a rectangular frame 26 attached to a shaft 25 of a pneumatic cylinder 24, squeezing plates 28,28' attached to the frame 26 in such a manner as to oppose to each other with a plate 27 interposed therebetween, and an expander plate 29 which is positioned between the squeezeing plates in a vertical posture and is carried by a shaft 33 for movement up and down relatively to the squeezing plates 28,28'.

In the above-described construction, the upper ends 30,30' of the squeezing plates 28,28' are bent in the vertical direction to preserve a space therebetween, and the expander plate 29 is positioned in this space. Reference numerals 34,34' denote gaps between the upper ends 30,30' of the squeezing plates 28,28' and opposing sides of the expander plate 29. Each of these gaps is selected to be slightly greater than the thickness of the sheet constituting the carton a'. The expander plate 29 has an inversed trapezoidal form and has cut corners 31,31'. A reference numeral 32 designates a coiled spring wound around the shaft 33 and adapted to relieve the shaft 33 (expander plate 29) upward and for self-resetting.

Figure 14:
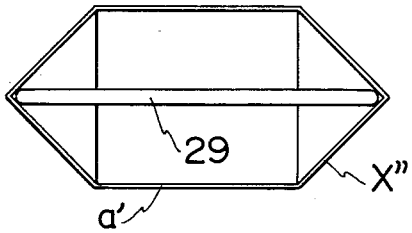
FIGS. 14 and 15 are illustrations of operation of the folding device for flat top type carton.
Figure 15:
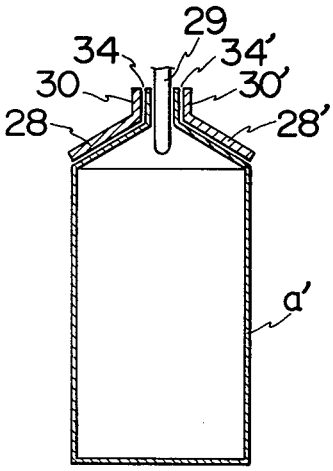

In the operation of the folding device for the flat carton top described heretofore, the frame 26 is lowered by the operation of the pneumatic cylinder 24 as shown in FIG. 14, so that the expander plate 29 comes into contact with the center of upper end of the carton a' to open the upper end of the carton a' laterally by the action of the tapered surfaces of the cut cirners 31,31'. In consequence, the carton is opened to have a hexagonal plan. At the same time, the squeezing plates 28,28' urges the upper edges of the carton toward the expander plate 29, so that the upper edges of the carton a' come into the gaps 34,34' as shown in FIG. 15. In FIG. 12, states of deformation of the carton a' are shown at X',X' and X'''.

After imparting the folding habit to the carton a in the manner explained above, the pneumatic cylinder 24 is actuated to raise the frame 26, so that the carton a' is moved away from the expander plate 29 and the squeezing plates 28,28' thereby to complete the folding operation leaving the folding habit in the carton top. Thus, the foldibg operation is completed by a one reciprocating motion of the device.

Figure 18:
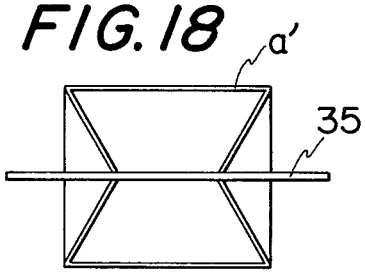
FIG. 18 is an illustration of the operation of the folding device for the gable top type container.
Figure 16:
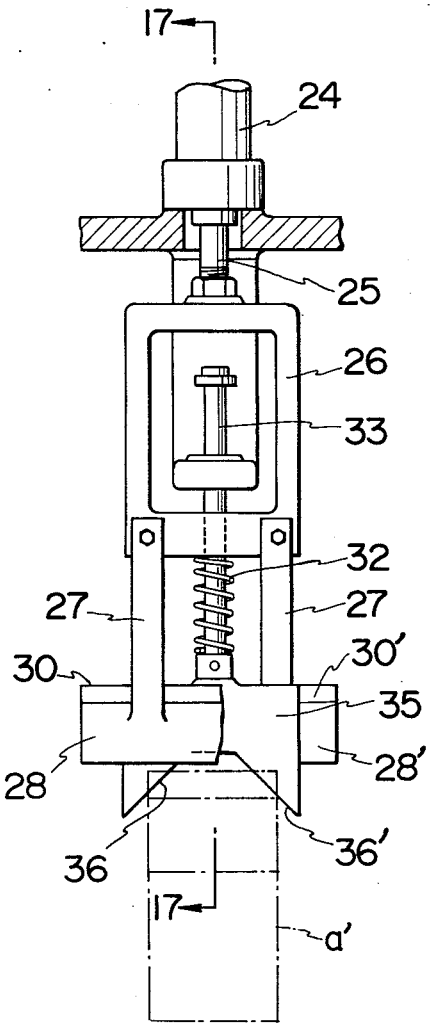
FIG. 16 is a front elevational view of a folding device for imparting a folding habit to the top of a gable top type container.
Figure 17:
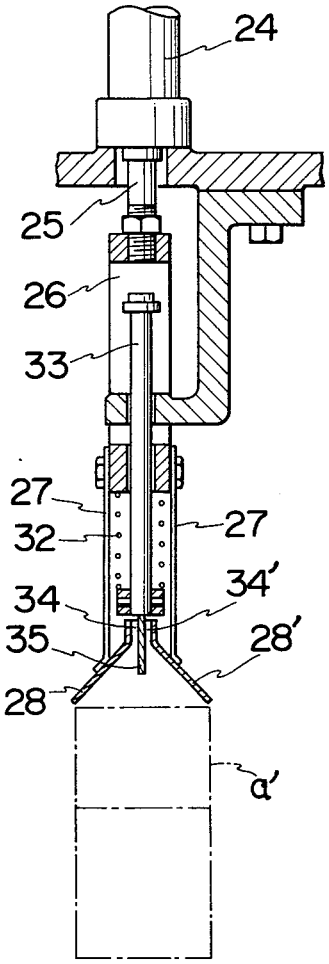
FIG. 17 is a sectional view taken along the line B—B of FIG. 16.

The folding device of another type, i.e. the folding device for gable top type carton is shown in FIGS. 16 and 17. This folding device has major parts such as the frame 26, squeezing plates 28,28' and so forth identical to those of the folding device for the flat top type. The sole difference resides in that the folding device for the gable top type carton incorporates a pressing plate 35 in place of the expander plate 25. Insteadly of the cut corners 31,31' of the expander plate 29, the pressing plate 35 is provided at its central portion with a trapezoidal pressing tapers 36 36'. In operation of this device, the frame 26 is lowered to bring the pressing tapers 36,36' into contact with the left and right upper edges of the carton a' from the outsides of the latter. Then, as the pressing plate 35 is lowered further, the left and right upper edges are folded inwardly as shown in FIG. 18. Then, as in the case of the operation illustrated in FIG. 15, the front and rear upper edges of the carton a' are brought together by the action of the squeezing plates 28,28'. Then, the frame 26 is raised leaving the gable top type folding habit in the carton top.

It is possible to obtain a constant folding habit because the top of the carton a' is beforehand provided with lines of folding and the folding is made along these lines of folding.

As will be understood from the foregoing description, the sole difference between the folding device for the flat top type carton and the folding device for the gable top type carton resides in that, while the former incorporates the expander plate 29, the latter employs the pressing plate 35. Other portions of these two devices are all identical. It is, therefore, possible to obtain two types of folding of carton top, i.e. the flat top and the cable top, simply by replacing the expander plate 29 with the pressing plate 35 and vice versa. It will be seen that there is no necessity of two different types of folding device for two kinds of folding of the carton top.

The heating device G for heating the top of the carton a' having the folding habit is of a known type, adapted to blow hot air from a nozzle to the carton top to heat and melt the polyethylene layer coating the surface of the carton a'.

Figure 1E:
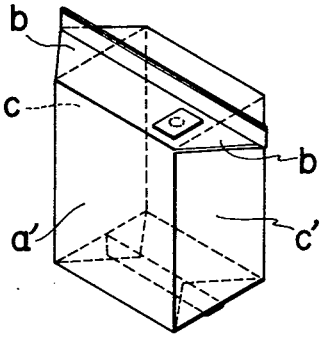
Figure 19:
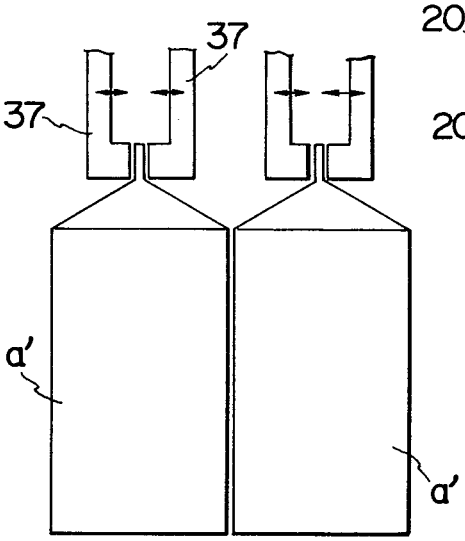
FIG. 19 is a side elevational view illustrating a top seal device.
Figure 20:
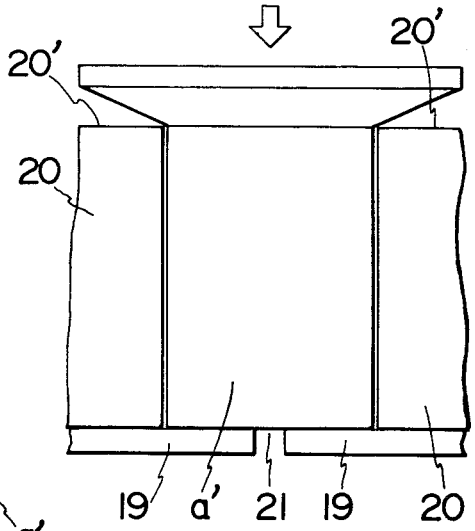
FIG. 20 is a front elevational view of the top seal device shown in FIG. 19.

As will be seen from FIG. 19, the sealing device H for linearly sealing the carton top incorporates smoothing irons 37 adapted to be pressed to both sides of the heated carton top. In the case where the carton is of the flat top type, the irons 37 are then lowered to collapse this portion of the carton top, on the upper face 20' of the block 20 of the conveyor device D. This state is shown at FIG. 20. The carton a' in this state takes a form as shown in FIG. 1E'.

Figure 2A:
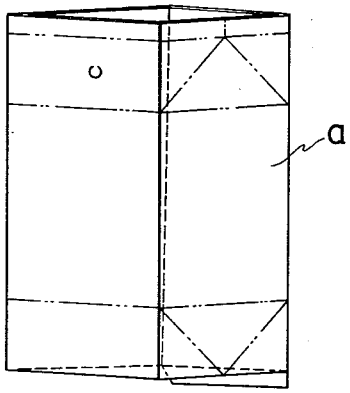
FIGS. 2A' to 2F' are perspective views showing a process for forming a gable top type carton and sealing the top of the carton.
Figure 2B:
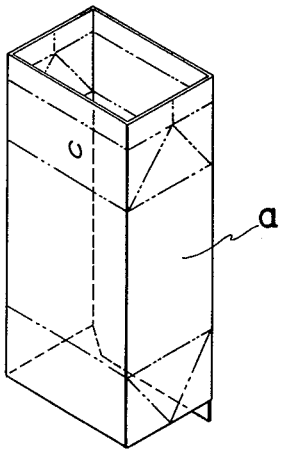
Figure 2D:
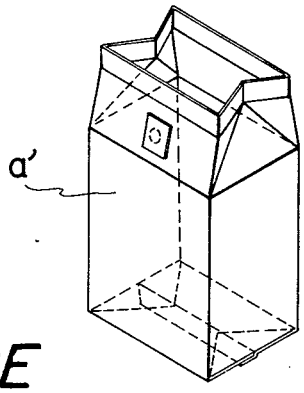
Figure 2C:
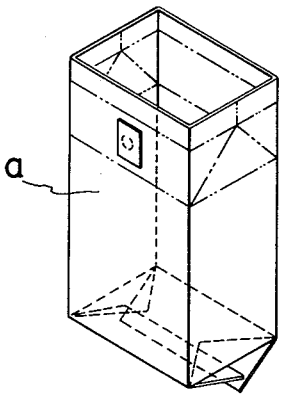
Figure 2E:
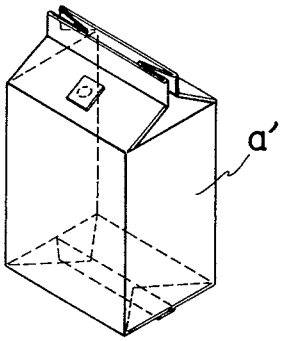
Figure 2F:
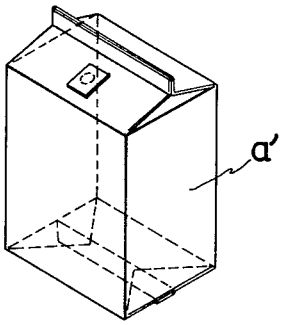

In the case where the carton is of the gable top type, the above-explained collapsing action is not performed after the linear sealing operation. In this case, the carton a' takes a form as shown in FIG. 2E'.

Figure 1F:
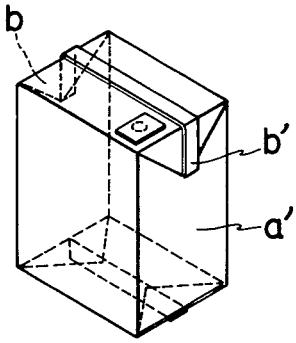

When the carton is of the gable top type, the cartons a', after completion of the sealing of the top subsequently to the above-explained series of operation, is ejected from the bucket portion 21 by an ejecting device to finish the whole process. In contrast, in the event that the carton is of the flat top type, it is necessary to treat the triangular lugs b,b' formed at both sides of the carton as shown in FIG. 1E', by folding the lugs and bonding the same onto the side surfaces c,c' of the carton a' as illustrated in FIG. 1F'.

Figure 21:
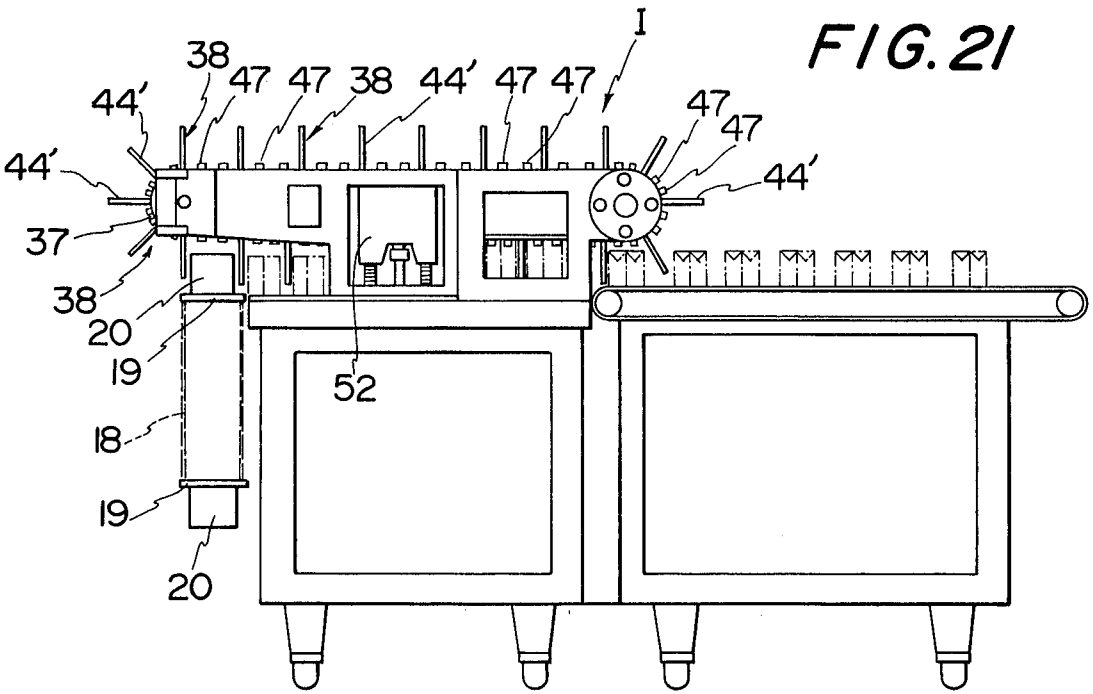
FIG. 21 is a right side elevational view of the automatic carton packing machine shown in FIGS. 3 and 4.

This operation is performed by the device I shown in FIGS. 3,4 and in FIG. 21.

Hereinafter, the operation of this device will be described in detail.

The construction of the whole part of this treating device is shown at FIGS. 3,4 and 21. More specifically, the treating device I includes as its major parts a clamp conveyor 37 arranged at a right angle to the direction of running of the bucket portion 21 and adapted to run in synchronization with the intermittent running of the conveyor device D, clamp sets 38 secured to the clamp conveyor 37 at the same pitch as the bucket portion 21, a hot-air blower adapted to heat, during running of the clamp set 38, the lugs b,b' of the carton a' and the portions of the side surfaces c,c of the carton a' onto which the lugs b,b' are to be folded and sealed to melt the film of plastic such as polyethylene coating the surface of the carton, a push-up device 40 for pushing up the carton a' after application of hot air, a clamp cam adapted to make the clamp sets 38 run while maintaining the lugs b,b' of the carton a' in the downwardly bent portion and to a clamp open cam 42 adapted release the clamp sets 38 after the fusion welding or bonding of the lugs b,b' to permit the carton a' to be ejected.

The operation of each part of the treating device I having the above-described construction with reference to the accompanying drawings. The clamp set 38 includes, as shown in FIG. 23, a base plate 43 attached to the clamp conveyor 37, a back pressing plates 44,44' attached to the rear end as viewed in the direction of running of the base plate 43 and extending in the vertical direction, driven members 46 provided at four points on the upper surface of the base plate 43 and having guide wheels 45, and eight clamp members pivotally carried by the driven members 46 to extend downwardly from the lower face of the base plate 43, the clamp members being so constructed as to bend the lugs b,b' downwardly and to clamp the same from both sides of the carton and being normally biased in the opening position.

Figure 22:
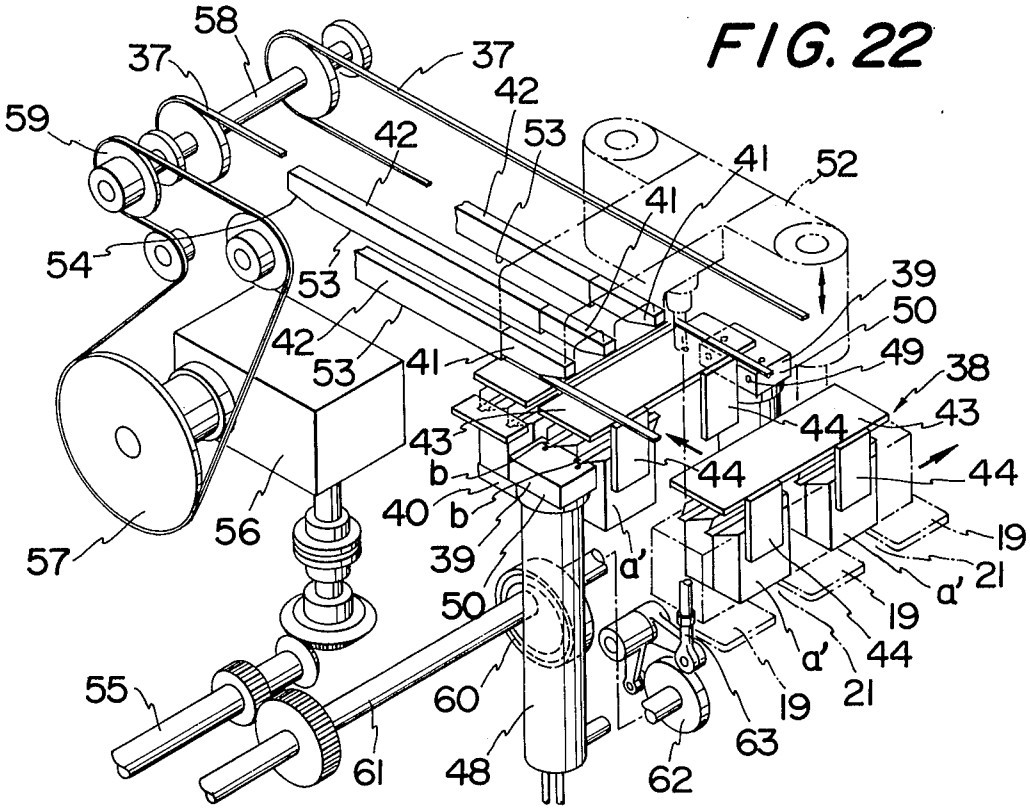
FIG. 22 is a perspective view of a part of a device for treating triangular lugs.

The hot-air blower 39 includes, as shown in FIG. 22, a hot-air generator 48 incorporating a cartridge heater therein and a head 50 including a hot-air nozzle 49 attached to the upper end of the hot-air generator 48. The hot-air blower is adapted to blow, when the carton a' is kept stopped, hot air against the lugs b,b' and the side surfaces c,c' of the carton a' to melt the plastic film on the latter.

Figure 23:
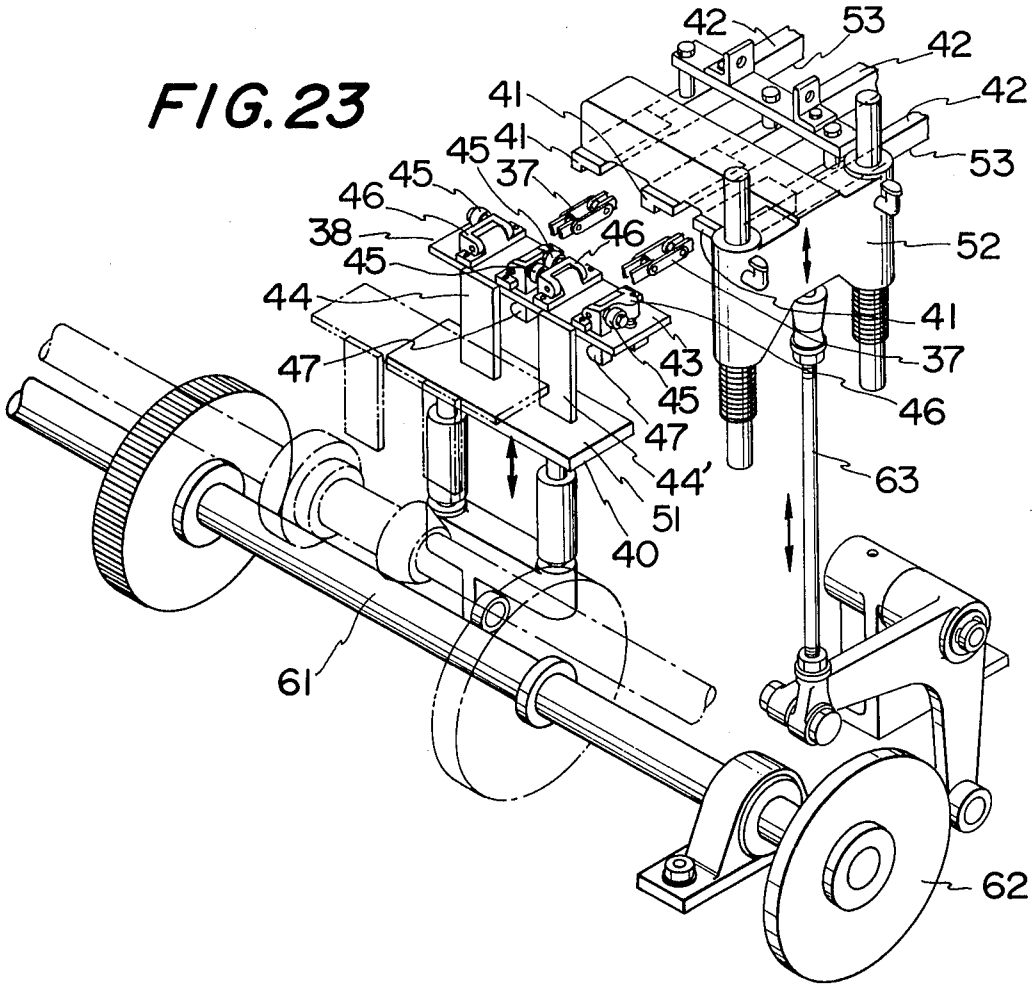
FIG. 23 is a perspective view of a clamping mechanism.

Referring now to the push-up device 40, this device includes a push-up base 51 adapted for pushing up the carton a' vertically upwardly as illustrated in FIG. 23. As the carton a' mounted on this push-up base 51 is pushed up, the lugs b,b' of the carton a' are pressed against rounded portions formed on the ends of the clamp members 47 thereby to bend the lugs b,b' downwardly at 90°.

The clamp cam 41 is secured to a clamp cam carrier 52 which is positioned above the push-up base 51 during running of the clamp set 38 and adapted to move up and down. The clamp cam 41 is adapted to make contact with the guide wheels 45 of the clamp set 38 from the upper side of the latter to actuate the clamp members 47.

The clamp closing cam 42 is extended in the direction of running of the clamp set 38 to follow the clamp set 38 as shown in FIG. 22. This clamp closing cam 42 has a clamp surface 53 adapted to actuate the clamp members 47 by depressing the guide wheels 45 of the clamp set 38 thereby to keep the lugs b,b' of the carton a' in the clamped state, and a cam surface 54 adapted for releasing the clamp members 47.

In FIG. 22, a reference numeral 55 designates a main shaft, 56 designates an index drive gear box, 57 designates an index outlet shaft drive gear, 58 denotes a clamp set driving shaft, 59 designates a driving sprocket gear, 60 denotes an operation cam of the push-up base 51, 61 designates a second cam shaft, 62 designates an operation cam for the clamp cam carrier 52 and 63 designates a connecting lever.

Figure 24:
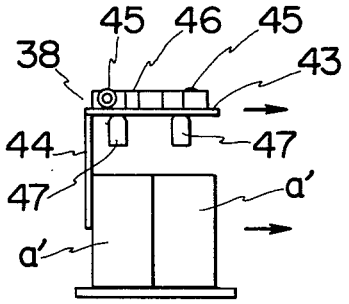
FIGS. 24 to 29 are illustration of operation of the device for treating the triangular lugs.

This device operates in a manner explained hereinbelow. Two cartons a' accomodated in each of the successive bucket portion 21 are taken out by the pack pushing plate 44 as shown in FIG. 24', while the bucket portion 21 is kept in the stopped state. The cartons a' thus taken out are horizontally moved on the table guide (not shown) by the clamp set 38 together with the latter, and are stopped at the position where the blowing of hot air is to be made by the hot-air blower 39. Meanwhile, the bucket portion 21 runs to bring the next cartons a' to the position for the taking out thereof by the clamp set 38.

Figure 25A:
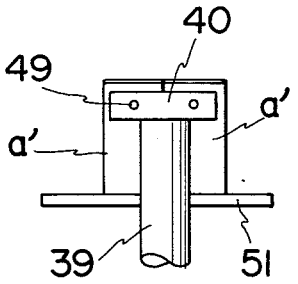
Figure 25B:
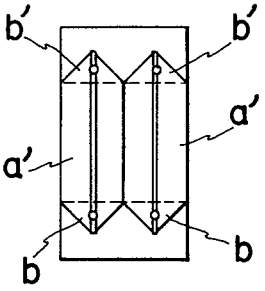

While the carton a' is kept in the stopped state, hot air is blown from the nozzle 49 of the hot-air blower 39 to heat the back sides of the lugs b,b' of the carton a' and the side surfaces c,c' of the same thereby to melt the plastic film as showing in FIG. 25(A)(B). After the melting of the plastic film, the carton a' is moved again by the clamp set 38 and is made to stop on the push-up base 51.

Figure 26A:
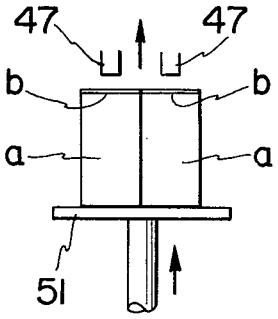
Figure 26B:
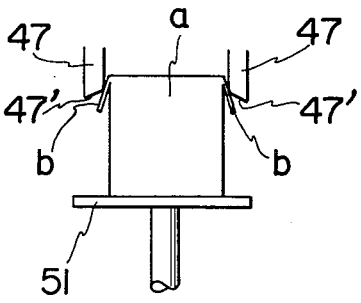
Figure 27:
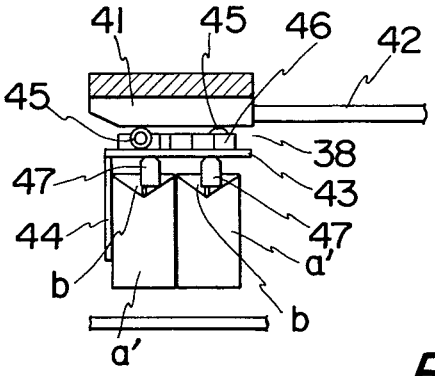

While the carton a' rests on the push-up base 51 and the clamp set 38 is kept stopped, the push-up base 51 is moved upward as shown in FIG. 26A, so that, during this upward movement, the lugs b,b' of the carton a' are brought into contact with the rounded parts 47' of the clamp members 47 to bend the lugs downwardly substantially at 90°. Then, as the upward movement of the push-up base 51 is ceased, the clamp cam carrier 52 is lowered as shown in FIG. 27, so that the clamp cam 41 come into contact with the guide wheels 45 of the clamp set 38 thereby to drive the driven member 46 to reduce the clearance between adjacent clamp members 47 to clamp the lugs b,b' of the carton a' from outer sides of the latter.

Figure 28:
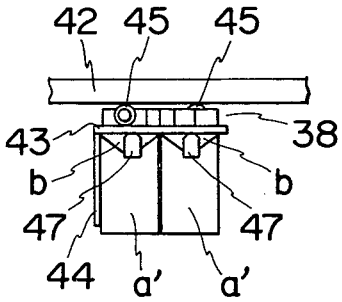
Figure 29:
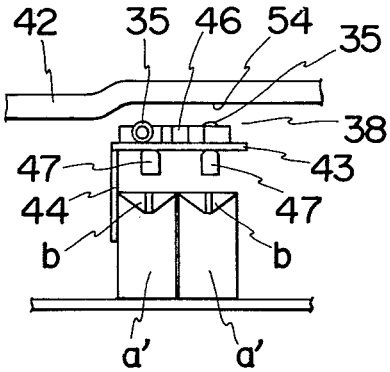

After this clamping operation, the push-up base 51 is moved downward so that the carton a' is suspended from the clamp members 47 of the clamp set 38. The clamp set 38 is moved in this state, so that the guide wheels 45 leave the clamp cam 41 and come to contact the clamp closing cam 42. Accordingly, the clamp members 47 are held in such a state as to suspend the carton a' as shown in FIG. 28, during which the lugs b,b' are heat-sealed and cooled by air to complete the sealing of the carton top. Thereafter, the guide wheels 45 reach the releasing cam surface 54 as illustrated in FIG. 29, so that the guide wheels 45 are reset upward by the force of the spring to release the clamp members 47. In consequence, the carton a' is released from the clamp members 47 and fall onto the table guide and are pushed again by the pack pushing plate 44, A series of packing operation is thus completed.

In the illustrated embodiment, the downward bending of the lugs b,b' of the carton a' is achieved by rounded portions 47' of the clamp members 47 to which the lugs are pressed as the carton a' is pushed up. This arrangement, however, is not exclusive, and the downward bending of the lugs b,b' may be effected by a baffle plate or the like provided separately from the clamp members 47.

As has been described, the treating device I for treating the triangular lugs is arranged at a right angle to the direction of running of the bucket 21, so that the lugs b,b' of the carton a' are treated to provide a perfectly flattened form of the carton top. This device I permits the reduction of the size of the whole machine and a safe treatment of the lugs formed on the carton top without fail.

In the illustrated embodiments, two cartons a' are taken out simultaneously from each of two bucket portions, i.e. four cartons a' are taken out simultaneously, due to a dual system arrangement. According to the invention, however, it is possible to handle 6 or 8 cartons a' at a time, by adopting a tripple or quadruple system arrangement. Namely, according to the invention, it is possible to obtain a remarkable increase of the treating capacity in a comparatively easy manner without requiring a substantial increase of the installation space.

As has been described, the present invention offers, by a combination of a novel shifting device C, conveyor device D, folding device F and a treating device I for treating the triangular lugs, various advantages such as increased efficiency of the works for forming the cartons, filling of the cartons, sealing of the carton top and treatment of the lugs on the carton top to enhance the efficiency of the production of packs. In addition, the size of the machine as a whole is conveniently reduced. Furthermore, it is quite advantageous that cartons of flat top type and cartons of gable top type are handled by the same machine.

What is claimed is:

1. An automatic carton packing machine comprising:

a magazine for accommodating a plurality of carton blanks in a flattened state;

means for extracting the carton blanks one by one;

means for opening the carton blanks into a rectangular form during extraction of the carton blanks;

a disc adapted to be rotated intermittently and having mandrels secured thereto, said mandrels being adapted to receive the open carton blanks;

means for effecting a bottom sealing of the open carton blanks while said disc rotates;

means for withdrawing the carton blanks from said mandrels and arraying the withdrawn carton blanks in rows;

means for pushing out the carton blanks intermittently by a distance corresponding to one carton blank from the rows to shift the carton blanks into successive ones of bucket portions of a bucket conveyor adapted to move in synchronization with intermittent rotary motion of said disc;

means for effecting, during the intermittent running of said bucket conveyor, filling of the carton blank with a substance;

means for folding the carton tops including means for forming triangular lugs extending outwardly of the carton tops; and means for bending the triangular lugs downwardly and sealing the bent triangular lugs against sides of the carton blanks to form completed and filled cartons having flat tops;

said means for bending the triangular lugs downwardly and sealing the bent lugs comprising:

a clamp conveyor arranged to move at right angles to a direction of movement of said bucket conveyor and adapted to run intermittently in a timed relationship with the running of said bucket conveyor;

a plurality of horizontally extending base plates connected along said clamp conveyor, each base plate including a substantially vertically extending back plate movable into said bucket portion to move a carton in said bucket portion out of said bucket portion;

at least two clamping members movably mounted to and extending from the bottom of each of said base plates for movement together to clamp a carton therebetween;

push-up means including a push-up plate onto which said back plates intermittently move at least one carton, said push-up means moving said push-up plate upwardly to move a carton thereon into engagement between said clamping members to fold the triangular lugs of the cartons downwardly;

clamp set means engageable with said clamping members for moving said clamping members together to clamp a carton therebetween after the triangular lugs have been folded down; and a hot air blower positioned to blow hot air toward an underside of the triangular lugs and side surfaces of the carton for sealing the triangular lugs against the side surfaces of the carton when the push-up plate pushes the carton into engagement between said clamping members.

2. A machine according to claim 1, wherein said means for arraying the withdrawn carton blanks in rows comprises a pair of guide rails extending along each row, said bucket conveyor including a plurality of blocks, said bucket portions of said conveyor comprising spaces between adjacent ones of said blocks, said conveyor movable intermittently to align each of said spaces with each of said pair of guide rails for receiving in each space at least one carton blank which is pushed into the space by said means for pushing out the carton blanks.

3. A machine according to claim 1, wherein said means for folding the carton tops comprises a frame, a shaft connected to said frame, drive means connecting to said shaft for moving said frame upwardly and downwardly, a pair of squeeze plates having outwardly and downwardly extending surfaces connected to said frame, and a folding plate connected to said frame between said squeeze plates defining gaps between each squeeze plate and said folding plate for separating or squeezing together opposite edges of the carton top, opposite edges which are moved by said squeeze plates.

4. A machine according to claim 3, wherein said folding plate is trapezoidal in shape and has upwardly and outwardly extending edges for moving opposite edges of the carton tops outwardly.

5. A machine according to claim 3, wherein said folding plate has a recessed area with inwardly and upwardly directed edges for folding opposite edges of the carton tops inwardly.

6. A machine according to claim 1, wherein said disc includes a plurality of circumferentially spaced depending mandrels, each mandrel adapted to receive one open carton blank, each mandrel including at least one relief groove recessed inwardly of a surface of said mandrel adapted to receive a carton blank and at least one withdrawal groove extending vertically, said means for withdrawing the carton blank comprising a withdrawing bar having a claw extending therefrom and drive means connected to said withdrawing bar for engaging a carton blank received on a mandrel and moving said claw through said withdrawal groove of said mandrel to withdraw the carton blank.

* * * * *